US005791546A

United States Patent [19]

McGuinness et al.

[11] Patent Number: 5,791,546

[45] Date of Patent: Aug. 11, 1998

[54] IMPROVED TIN TAG DISPENSING APPARATUS AND CARTRIDGE

[75] Inventors: Thomas J. McGuinness, Tequesta, Fla.; James M. McGuinness, Decatur, Ala.

[73] Assignee: 3J Design, Inc., Fla.

[21] Appl. No.: 801,215

[22] Filed: Feb. 18, 1997

Related U.S. Application Data

[63] Continuation-in-part of Ser. No. 456,861, Jun. 1, 1995, Pat. No. 5,634,583.

[51] Int. Cl.[6] ..... B25C 7/00

[52] U.S. Cl. ..... 227/120; 227/119; 227/138

[58] Field of Search ..... 227/119, 120, 227/138, 99

[56] References Cited

U.S. PATENT DOCUMENTS

| | | | |
|---|---|---|---|
| 2,385,521 | 9/1945 | Mead . | |
| 2,886,815 | 5/1959 | Young | 227/120 |
| 3,595,460 | 7/1971 | Pitkin . | |
| 3,734,377 | 5/1973 | Munn | 227/120 |
| 4,246,939 | 1/1981 | Boegel . | |
| 4,339,065 | 7/1982 | Haytayan . | |
| 4,657,167 | 4/1987 | Mays . | |
| 4,890,968 | 1/1990 | Beach . | |
| 4,998,662 | 3/1991 | Hasan . | |
| 5,067,865 | 11/1991 | Zylka . | |
| 5,184,752 | 2/1993 | Zylka . | |

*Primary Examiner*—Scott A. Smith
*Attorney, Agent, or Firm*—Laubscher & Laubscher

[57] ABSTRACT

A roofing gun attachment for dispensing tin tags includes a base, a supply chamber mounted on the base which receives a cartridge containing a plurality of stacked planar tin tags, a shuttle slidably disposed within the base for individually displacing the tin tags from a feeding station located below the supply chamber to a nailing station where the tin tag is pierced by a nail discharged from a nailing gun, and a pair of cam arms each connected with a slide member for moving the shuttle between the feeding station and the nailing station when the nailing gun is pressed against a nailing surface and lifted therefrom. The supply chamber includes an access door which allows the tin tag cartridge to be easily replaced and further includes a manually-actuated spring-loaded plunger which biases the tin tags toward the feeding station.

15 Claims, 4 Drawing Sheets

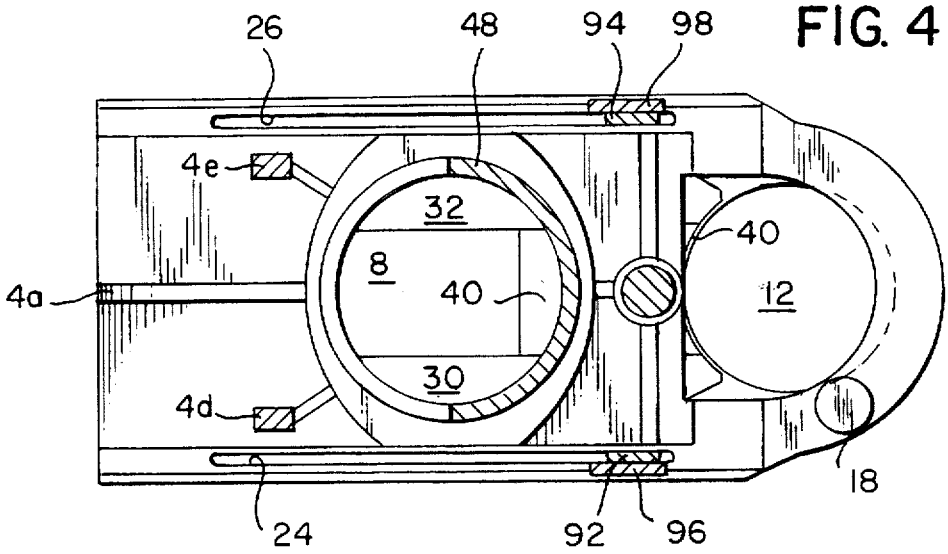
FIG. 4
FIG. 5
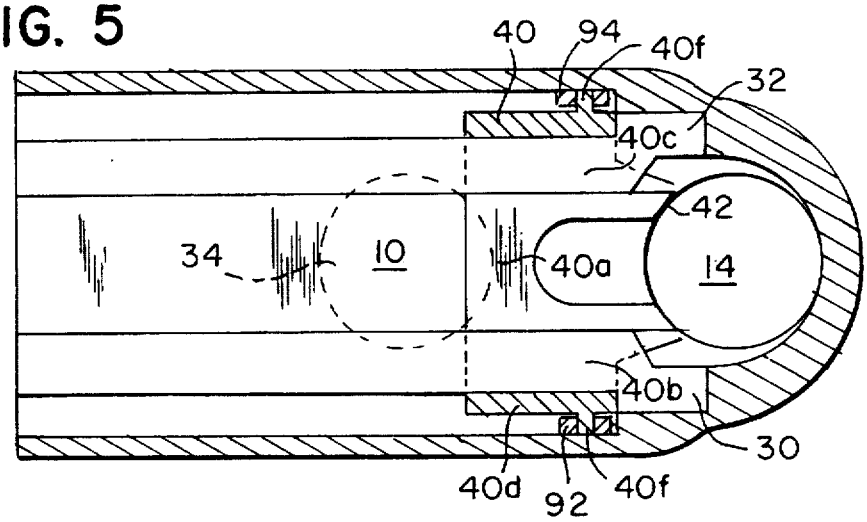
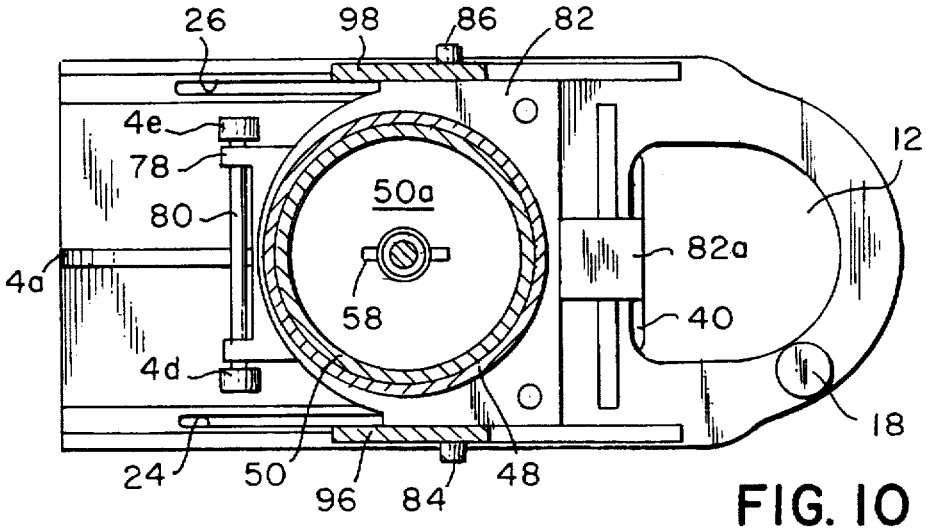
FIG. 10

IMPROVED TIN TAG DISPENSING APPARATUS AND CARTRIDGE

BACKGROUND OF THE INVENTION

REFERENCE TO RELATED APPLICATION

This is a continuation-in-part of application Ser. No. 08/456,861 filed Jun. 1, 1995, now U.S. Pat. No. 5,634,583.

FIELD OF INVENTION

The present invention relates to an improved tin tag dispensing attachment for a hand-held, pneumatically-operated nailing gun which individually dispenses tin tags which are fastened to a nailing surface, such as a roof, by a fastener discharged from the nailing gun.

BRIEF DESCRIPTION OF THE PRIOR ART

The building code in certain jurisdictions requires tin tags (also referred to as roofing washers, plates or disks) to be placed at specified distances on the roof to securely fasten an overlay of black paper or the like to a wooden roof structure. It is currently the custom to hand place the tin tags on the overlay and to nail the tin tag to the roof using a pneumatically-operated hand-held nailing gun such as the Hitachi Nailer, Model NV45AB. This method, however, has several disadvantages and drawbacks. Because the typical tin tag has a diameter of approximately 1.625 inches, it is difficult for the nailing gun operator to center the nail on the tin tag. If the nail is too far off center, it causes the edges of the tin tag to become raised, which raised edges can then puncture the overlay. Also, hand placement of the tin tags presents a serious safety hazard to the user of the gun. Since the tin tag is placed by hand, the operator's fingers are frequently near the barrel of the nailing gun and presents the possibility for the nailing gun operator to inadvertently shoot a nail into his finger.

Attachments to air powered tools for dispensing work-pieces into a position where they can be pierced by a fastener driven by the tool are known in the patented prior art, as evidenced by the patents to Beach U.S. Pat. No. 4,890,968 and to Zylka et al, U.S. Pat. No. 5,067,865.

The Beach patent discloses a washer-dispensing and fastener-driving machine for individually dispensing roofing washers and driving a fastener therethrough. The machine includes a base, a chute mounted on the base which is adapted to receive a stack of washers, a shuttle mounted to the base which engages and displaces a single washer, and a linkage which links the machine to a stand-up screw gun.

The Zylka et al patent discloses an apparatus for feeding disks to an automatic staple or nail gun which includes a disk canister, a shuttle guide mount, a shuttle, a shuttle, and a shuttle actuator arm.

These devices have not achieved widespread use in the roof construction industry because they require alteration or modification to the commercially available nailing guns currently used in the roofing industry, must be purchased as a preassembled integral unit with a new nailing gun, are prone to jamming, and often cannot be used with commercially available tin tags. In addition, refilling these devices with tin tags can be a difficult and time consuming task.

There exists a need, therefore, for a reliable light-weight dispensing attachment which can be easily and quickly refilled with tin tags, connected and disconnected from the hand-held roofing guns currently being used in the roofing industry, and which can operate using commercially available tin tags without jamming. The present invention was developed to overcome these and other drawbacks of the prior art devices by providing an improved nailing gun attachment which includes a base, a supply chamber mounted on the base for receiving a cartridge filled with tin tags, a shuttle for individually displacing the tin tags from a feeding station located below the supply chamber to a nailing station, and a pair of cam arms which move the shuttle between the feeding station and the nailing station when the nailing gun is pressed against and lifted from the nailing surface.

SUMMARY OF THE INVENTION

Accordingly, a primary object of the present invention is to provide an improved roofing gun attachment which can be easily retrofit to existing nailing guns and which is operable to dispense commercially available tin tags from a removable cartridge or magazine contained within the attachment. More particularly, it is an object of the present invention to provide a tin tag dispensing apparatus including a base, a supply chamber mounted on the base which receives the cartridge containing a plurality of stacked planar tin tags, a shuttle slidably disposed within the base for individually displacing the tin tags from a feeding station located below the supply chamber to a nailing station where it is pierced by a nail discharged from a nailing gun, and a pair of cam arms connected with a slide member mounted on the supply chamber which move the shuttle between the feeding station and the nailing station when the nailing gun is respectively pressed against and lifted from a nailing surface, such as a roof.

It is a further object of the invention to provide a nailing gun attachment having guide rails mounted within the base to define a feed slot which allows a single tin tag to be dispensed from the supply chamber and displaced by the shuttle to the nailing position.

It is another object of the invention to provide a nailing gun attachment having an access door in the supply chamber which allows the tin tag cartridge to be quickly and easily changed.

It is yet another object of the invention to provide a tin tag dispensing attachment which is light weight, reliable, and easy to operate.

BRIEF DESCRIPTION OF THE DRAWINGS

Other objects and advantages of the invention will become apparent from a study of the following specification, when viewed in the light of the accompanying drawings, in which:

FIG. 4 is a sectional view taken along line 4—4 of FIG. 1;

FIG. 5 is a sectional view taken along line 5—5 of FIG. 3;

FIG. 10 is a sectional view taken along line 10—10 of FIG. 1.

DETAILED DESCRIPTION

Figure 1:
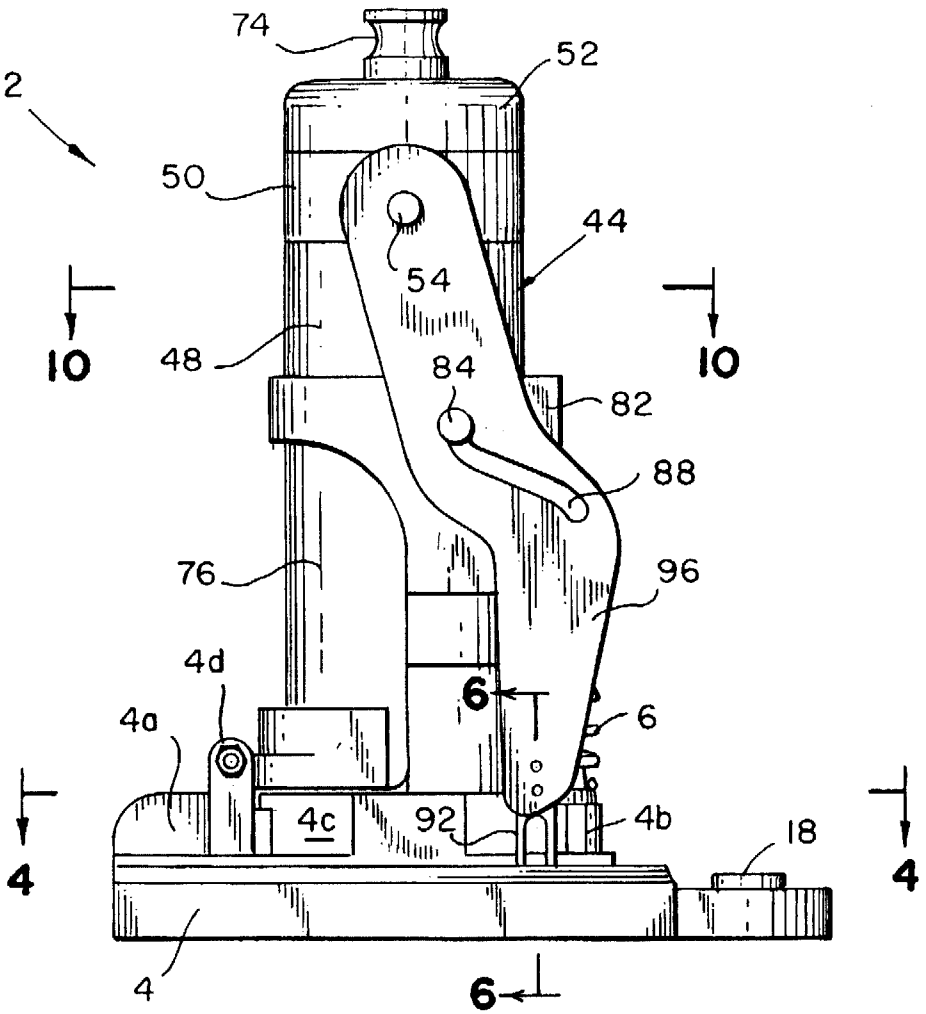
FIG. 1 is a side plan view of the nailing gun attachment of the present invention in the normal tag-nailing position.
Figure 3:
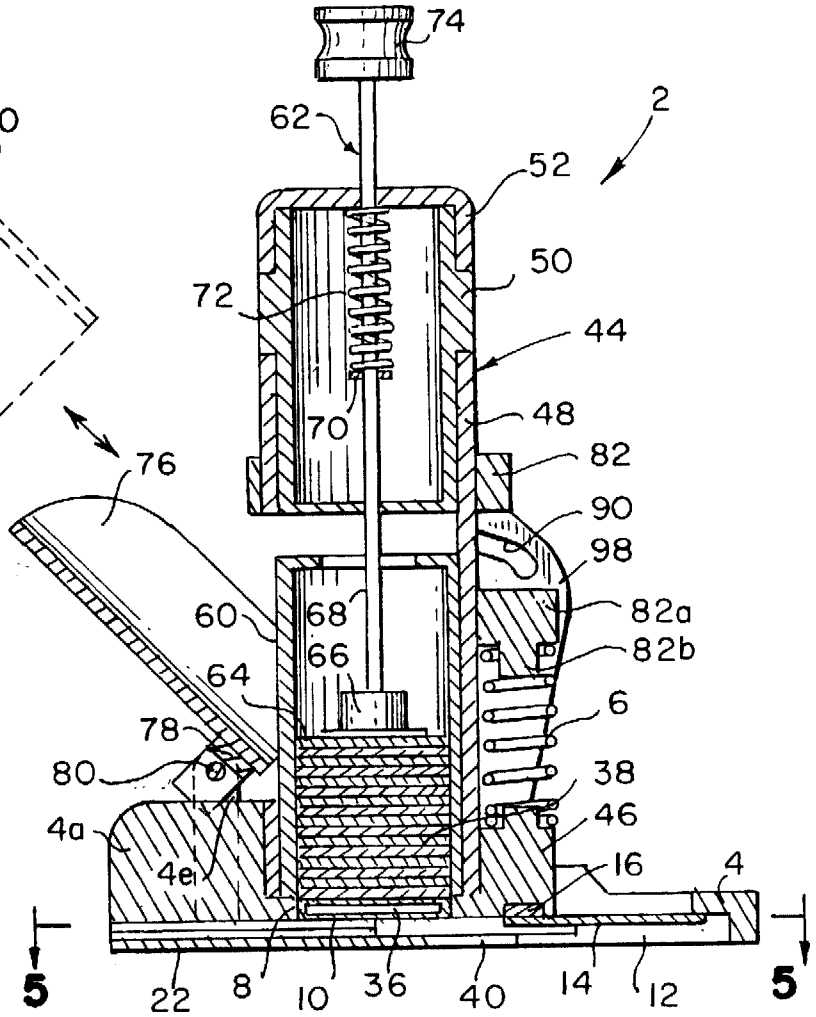
FIG. 3 is a sectional side view of the nailing gun attachment of FIG. 1 with the cover int he cartridge loading position.
Figure 2:
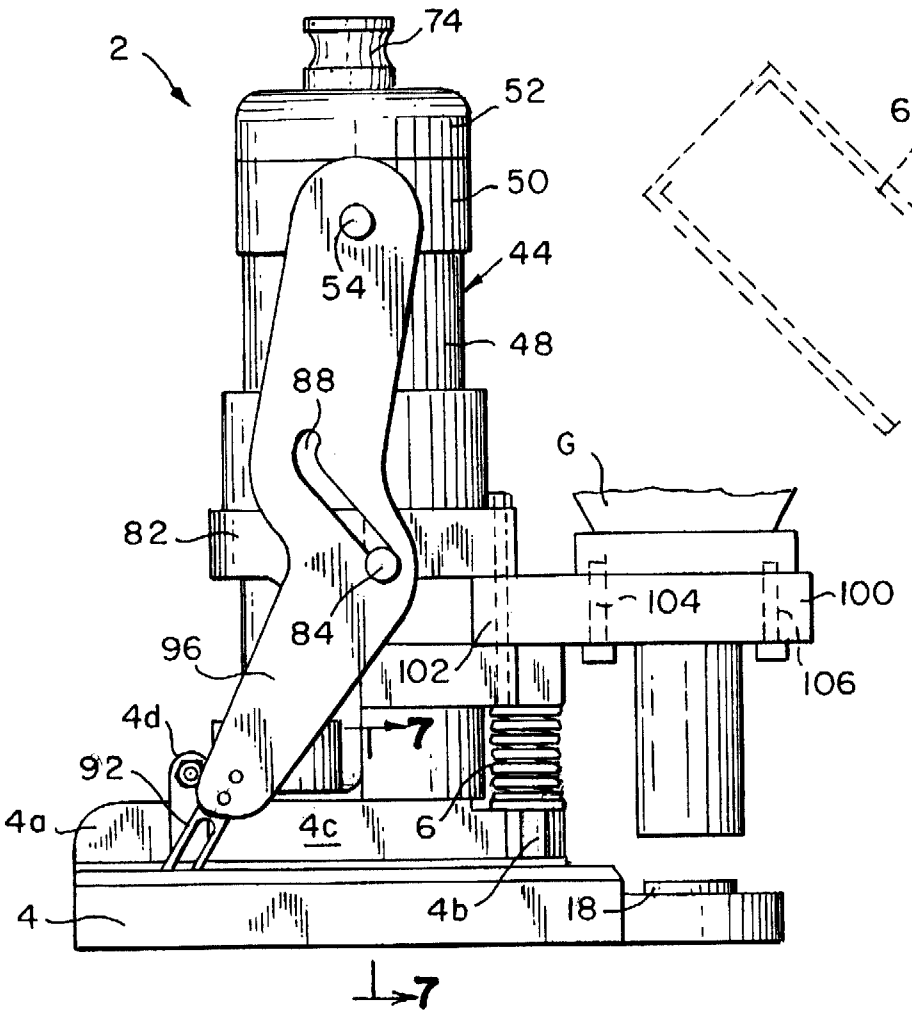
FIG. 2 is a side plan view of the nailing gun attachment of FIG. 1 in the tag-loading position.

Referring first to FIGS. 1–3, a nailing gun attachment 2 includes a base 4 having a raised tail portion 4*a* for providing structural support, and a raised spring support portion 4*b* having mounted thereon a recoil spring 6, such as a helical compression spring. The base contains a centrally located through-bore 8 which defines a feeding station 10, and a forwardly located through bore 12 which defines a nailing station 14. A pair of magnets 16 and 18 are provided at the nailing station to maintain a tin tag at the nailing station 14 before a nail discharged from the nailing gun G pierces the tin tag.

Figure 6:
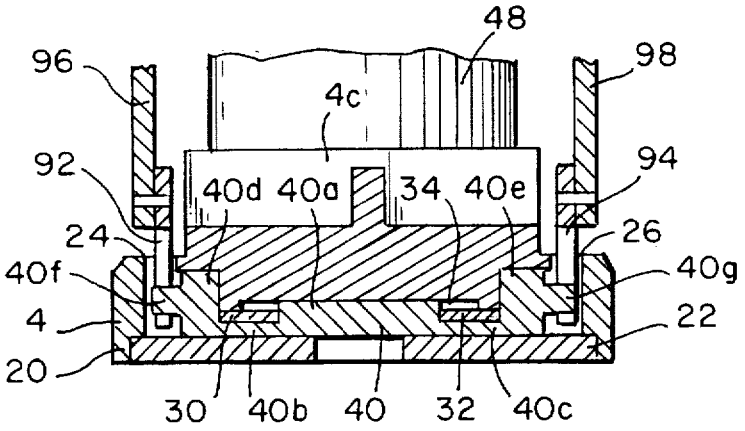
FIG. 6 is a sectional view taken along line 6—6 of FIG. 1.
Figure 7:
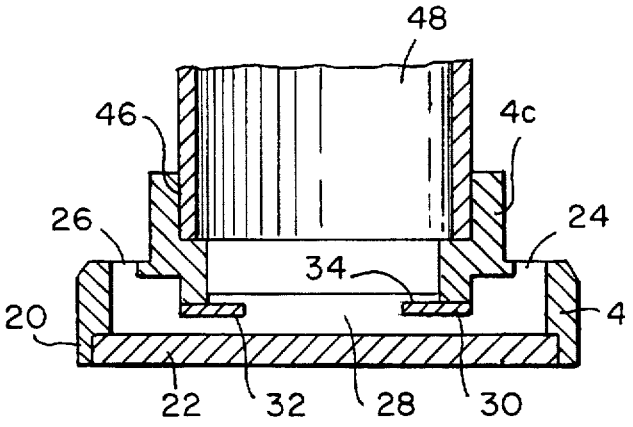
FIG. 7 is a sectional view taken along line 7—7 of FIG. 2.
Figure 8:
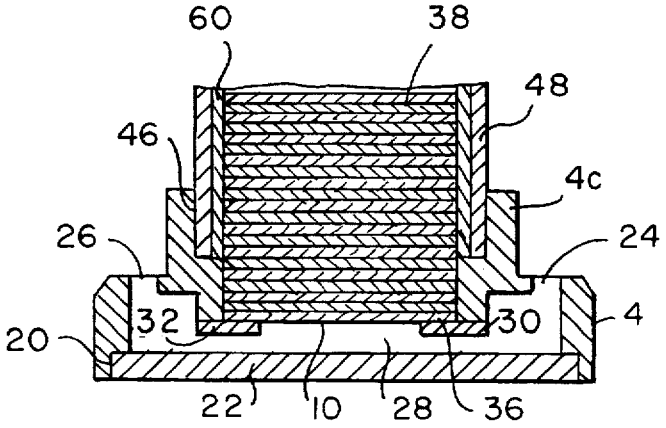
FIG. 8 is the sectional view of FIG. 7 with a cartridge containing tin-tags arranged in the supply chamber.

As shown best in FIGS. 6–8, the bottom of the base 4 contains a longitudinal recess 20 which receives a base plate 22. The base further contains a pair of parallel guide slots 24 and 26 which communicate with a longitudinal channel 28 which extends from the feeding station 10 to the nailing station 14.

A pair of guide rails 30 and 32 are mounted on the base within the longitudinal channel 28 and define a feed slot 34 (FIG. 7) at the feeding station 10. The feed slot 34 is sized to allow only the lower-most tin tag 36 to be dispensed from the stack of tin tags 38. The size or depth of its feed slot depends on the thickness of the tin tag being used. Typically, tin tags have a thickness of between 0.01 and 0.02 inches. If, for example, a tin tag having a thickness of 0.016 inches is used, a feed slot depth of 0.018–0.019 inches would allow the tin tags to be individually dispensed without joining. The tin tags are formed of a suitable metal, such as steel, or a suitable synthetic plastic material such as PVC.

A shuttle 40, which reciprocates between the feeding station and the nailing station, is slidably disposed within channel 28. As shown best in FIGS. 5 and 6, the shuttle includes a center portion 40*a* which extends upwardly between the guide rails 30 and 32 and into the feed slot 34, whereby the shuttle can engage and displace the lower-most tin-tag 36 from the bottom of the stack to the nailing station. The forward end of the center portion 40*a* is provided with an angled ledge 42 (FIGS. 4 and 5) which serves to hold the tin tag in position.

The shuttle further includes a pair of oppositely extending wing portions 40*b* and 40*c* which extend below guide rails 30 and 32, respectively. A pair of end portions 40*d* and 40*e* extend upwardly from the remote ends of the wings 40*b* and 40*c*, respectively, and a pair of boss portions or protrusions 40*f* and 40*g* extend oppositely outwardly below guide slots 24 and 26, respectively.

Figure 9:
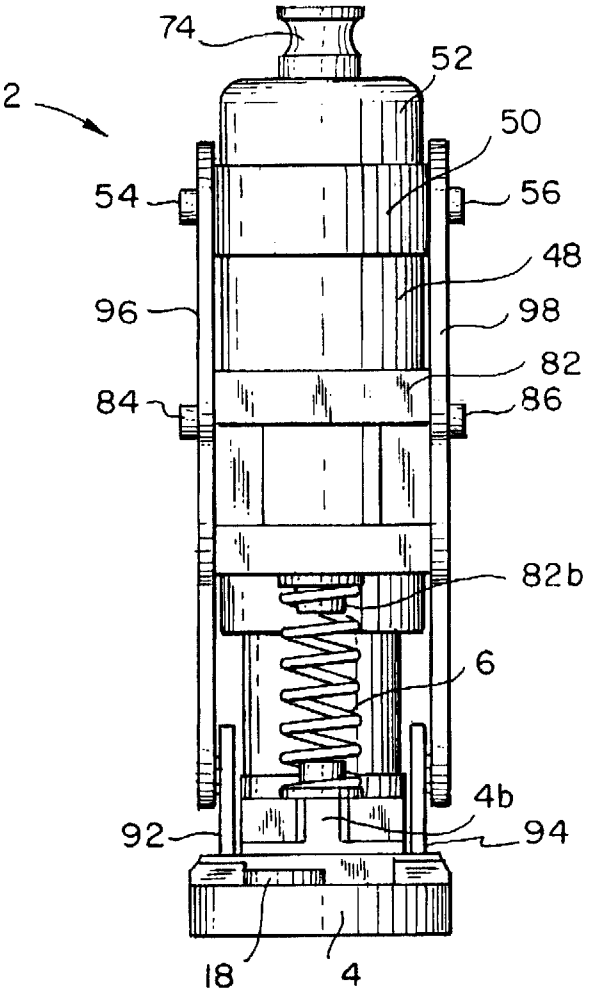
FIG. 9 is a front plan view of the nailing gun attachment of FIG. 1.

A supply tube 44 is mounted on the base 4 adjacent the feeding station 10. The base includes a raised wall portion 4*c* to provide structural support for the supply tube 44. As shown in FIG. 3, the supply tube 44 includes a lower section 48 mounted on the base 4, an upper section 50 which is mounted on the lower section 48, and a cap 52 which is mounted on the upper section 50. As shown in FIGS. 7 and 8, the lower section 48 is mounted in a counter bore 46 contained in the base 4. As shown in FIG. 9, the upper section 50 includes a pair of fixed pivot pins 54 and 56, and as shown in FIG. 10, the bottom wall portion 50*a* of the upper section 50 contains a keyway 58.

A removable cartridge 60 containing the stacked planar tin tags 38 fits within the lower section 48 of the supply tube 44. The cartridge, which may be recycled or disposed of following use, is provided to facilitate loading the device with tin tags. The top of the cartridge is open to allow a spring-loaded plunger 62 to engage the upper-most tin tag 64 and bias the stack of tin tags toward the feeding station 10. The bottom of the cartridge is also open to allow the tin tags to be dispensed therefrom.

The spring-loaded plunger 62 includes a head 66, a rod 68 which is connected with the head and extends from the lower section 48 of the supply tube through upper section 50 and through cap 52, a key 70 which extends through the rod, a helical compression spring 72 arranged around the rod and engaging the key 70, and a handle 74 connected with the rod 68. Thus, as the handle 74 is pulled to withdraw the rod 68 from the supply tube 44, the spring 72 is compressed between the key 70 and the cap 52, thereby biasing the plunger downwardly against the tin tags which, in turn, are urged toward the feeding station 10. The recoil spring 6, magnets 16 and 18, and spring loaded plunger 62 allow the attachment to dispense tin tags regardless of its orientation. That is, the attachment can be tilted so that tin tags can be fastened to a vertical wall surface or it can be turned upside down for fastening tin tags on a ceiling.

The lower section 48 of the supply tube is provided with a pivoting access door 76 to allow the tin tag cartridge 60 to be easily inserted and removed from the supply tube 44. The access door is pivotally mounted on the base 4 via a mounting adapter 78 which is fastened to the access door 76, a pivot pin 80 which passes through the mounting adapter 78, and a pair of pivot pin supports 4*d* and 4*e* which are formed integrally with the base 4.

An annular slide member or collar 82 is slidably mounted on the supply tube lower section 48. The slide member includes a forward protrusion 82*a* (FIGS. 3 and 10) having a downwardly extending stub portion 82*b* which is axially aligned with spring support portion 4*b* and engages the upper end of spring 6. Slide member 82 further includes a pair of oppositely extending cam pins 84 and 86 (FIG. 9).

A pair of cam arms 96 and 98 containing cam slots 88 and 90, respectively, are connected at their upper ends to the supply chamber upper section 50 by pivot pins 54 and 56, respectively. Cam pins 84 and 86 connected with the vertically displaceable slide collar 82 extend within cam slots 88 and 90, respectively, thereby causing cam arms 96 and 98 to reciprocate within the guide slots 24 and 26, respectively, as slide collar 82 moves vertically up and down on the supply tube 44. Cam arm 96 and 98 include forks 92 and 94 at their lower ends which extend through guide slots 24 and 26, and engage shuttle protrusions 40*f* and 40*g*, respectively, thereby to drive the shuttle.

As shown in FIG. 2, the attachment is connected with the nailing gun G by means of an adapter plate 100 which is connected with the slide member 82 via fastener 102 and is connected with the gun via fasteners 104 and 106.

To minimize the overall weight of the device, the base 4, supply tube 44, slide member 82, and cam arms 96 and 98 may be formed of a durable, high-strength synthetic plastic material such as DELRIN and the guide rails 30 and 32, shuttle 40, and forks 92 and 94 are formed of a metal, such as stainless steel, which is highly resistant to wear.

OPERATION

To install a cartridge 60 containing tin tags into the supply chamber 44, the attachment must be in the normal retracted nailing positions shown in FIGS. 1 and 3, wherein slide member 82 is slid upwardly on the supply chamber. The access door 76 is then opened and the spring-loaded plunger 62 is manually displaced upwardly so that the cartridge can be inserted or removed from the device via the access door. It will be recognized that the plunger may be locked in its retracted or raised position by lifting the plunger until key 70 passes through the keyway 58 into the upper chamber 50. By rotating the plunger, the key be prevented from passing through the keyway and will instead engage wall 50*a*, thereby maintaining the plunger in its retracted position.

When the roofing gun G is pressed against a fixed surface such as a roof, the attachment will assume the actuated position shown in FIG. 2. In this position, the lower-most tin tag 36 is forced downwardly into the feeding station 10 by the spring-biased plunger 62. When the gun is lifted, spring 6 biases slide member 82 upwardly along the supply chamber 44 which, in turn, causes the cam arms 92 and 94 to move the shuttle 40 whereby the shuttle engages the lowermost tin tag and displaces it from the feeding station 10 to the nailing station 14. Once at the nailing station, the tin tag is held in place by magnets 16 and 18 until it is pierced by a nail discharged from the nailing gun and is thereby secured to the roof.

While in accordance with the provisions of the Patent Statutes the preferred form and embodiments of the invention have been illustrated and described, it will be apparent to those skilled in the art that various changes and modifications may be made without deviating from the inventive concept set forth above.

What is claimed is:

1. A nailing gun attachment for individually dispensing and positioning tin tags, comprising:

(a) a base having a top surface containing a pair of spaced parallel guide slots, a longitudinally extending channel arranged between and generally parallel to said slots, a first through-bore defining a feeding station, and a second through-bore defining a nailing station;

(b) means defining a hollow supply chamber mounted on said base adjacent said feeding station;

(c) a slide member connected for sliding movement relative to said supply chamber means;

(d) guide rail means mounted on said base defining a feed slot extending from said feeding station to said loading station;

(e) a shuttle slidably mounted within said channel for reciprocating movement between said feeding station and said nailing station;

(f) at least one cam arm having an upper end pivotally connected with said supply chamber means, and a lower end pivotally connected with said shuttle, and pin and cam slot means connecting said slide member with said at least one cam arm, whereby when said slide member slides along said supply chamber means, said at least one cam arm causes said shuttle to be displaced within said channel toward one of said feeding and nailing stations.

2. A nailing gun attachment as defined in claim 1, wherein said shuttle includes a boss portion, and further wherein said at least one cam arm lower end includes a forked portion extending through one of said guide slots to engage said shuttle boss portion.

3. A nailing gun attachment as defined in claim 2, wherein said supply chamber means includes an access door affording access to the interior of said supply chamber means.

4. A nailing gun attachment as defined in claim 3, wherein said supply chamber means includes plunger means for biasing said tin tags toward said feeding station.

5. A nailing gun attachment as defined in claim 4, and further including a removable plate mounted on said base, said shuttle being supported on said plate.

6. A nailing gun attachment as defined in claim 5, and further comprising a removable cartridge arranged within said supply chamber adjacent said feeding station, said cartridge being adapted to receive a plurality of stacked tin tags.

7. A nailing gun attachment as defined in claim 6, wherein said slide member includes mounting means for connecting said base with a nailing gun.

8. A nailing gun attachment as defined in claim 7, and further comprising biasing means arranged between said base and said slide member for biasing said base and said slide members apart.

9. A nailing gun attachment as defined in claim 8, wherein said biasing means includes a compression spring.

10. A nailing gun attachment as defined in claim 9, wherein said base is formed of a synthetic plastic material.

11. A nailing gun attachment as defined in claim 10, wherein said supply chamber means is formed of a synthetic plastic material.

12. A nailing gun attachment as defined in claim 11, wherein said feed slot is of such a size as to dispense successively a single tin tag.

13. A nailing gun attachment as defined in claim 12, and further comprising positioning means for holding a single tin tag at said nailing station, said positioning means including a first magnet mounted on said base between said guide rails.

14. A nailing gun attachment as defined in claim 13, wherein said supply chamber means includes a dividing wall defining a lower chamber containing the tin tags and an upper chamber containing a spring arranged about said plunger, and further wherein said dividing wall includes a keyway adapted to receive a pin mounted on said plunger, whereby said plunger can be manually actuated to cause said key to pass through said keyway and lock said plunger in a retracted upright position, thereby to allow said cartridge to be inserted or removed from said lower chamber.

15. Apparatus as defined in claim 1, wherein said slide member is annular and is mounted concentrically about said supply chamber means.

* * * * *